United States Patent [19]

Kuse

[11] 4,307,500

[45] Dec. 29, 1981

[54] APPARATUS FOR SEVERING AND PAIRING SLIDE FASTENER STRINGERS

[75] Inventor: Kazuki Kuse, Toyama, Japan

[73] Assignee: Yoshida Kogyo K. K., Tokyo, Japan

[21] Appl. No.: 127,050

[22] Filed: Mar. 4, 1980

[30] Foreign Application Priority Data

Mar. 5, 1979 [JP] Japan ..... 54-25320

[51] Int. Cl.[3] ..... B23P 19/04; B24D 5/00

[52] U.S. Cl. ..... 29/33.2; 29/34 A; 29/408; 29/766; 83/921

[58] Field of Search ..... 29/33.2, 33 K, 34 A, 29/408, 766, 770, 564.3; 83/921

[56] References Cited

U.S. PATENT DOCUMENTS

| | | | |
|---|---|---|---|
| 2,287,263 | 6/1942 | Nedal | 29/408 |
| 2,613,433 | 10/1952 | Rojahn | 29/408 |
| 3,353,256 | 11/1967 | Frohlich et al. | 29/766 X |
| 3,626,579 | 12/1971 | Maeda | 29/408 |
| 3,714,698 | 2/1973 | Fukoroi | 29/408 |

FOREIGN PATENT DOCUMENTS

| | | | |
|---|---|---|---|
| 442328 | 2/1936 | United Kingdom | 29/408 |

*Primary Examiner*—Z. R. Bilinsky

*Attorney, Agent, or Firm*—Hill, Van Santen, Steadman, Chiara & Simpson

[57] ABSTRACT

An apparatus for manufacturing slide fastener stringer pairs of a slide fastener length from a pair of continuous slide fastener stringers. The apparatus comprises means for severing the continuous slide fastener stringers transversely across one of element-free portions, means for pairing the severed slide fastener stringers, and gripping means reciprocable between a first position adjacent to the severing means and a second position disposed away from the first position for advancing the slide fastener stringers along a longitudinal path. The gripping means includes a pair of grippers movable toward each other for introducing the slide fastener stringers into the pairing means.

7 Claims, 16 Drawing Figures

APPARATUS FOR SEVERING AND PAIRING SLIDE FASTENER STRINGERS

BACKGROUND OF THE INVENTION

1. Field of the Invention

The present invention relates generally to apparatus for manufacturing slide fasteners and more particularly to an apparatus for severing a pair of unengaged slide fastener stringers of a continuous length and for pairing the severed slide fastener stringers.

SUMMARY OF THE INVENTION

A pair of grippers is reciprocable between a first position adjacent to a severing means and a second position away from the first position for advancing a pair of slide fastener stringers along a longitudinal path. The pair of grippers are movable toward each other for introducing the slide fastener stringers into a pairing means.

The pairing means includes a fixed first member and a second member movable toward the first member to define therebetween a passage for the slide fastener stringers, and to press the latter between the first and second members.

Accordingly, it is an object of the present invention to provide an apparatus of the described type which can pair or mate a pair of unengaged slide fastener stringers accurately and efficiently.

Another object of the invention is to provide an apparatus of the described type which can be automated with minimum cost.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF A PREFERRED EMBODIMENT

Figure 1:
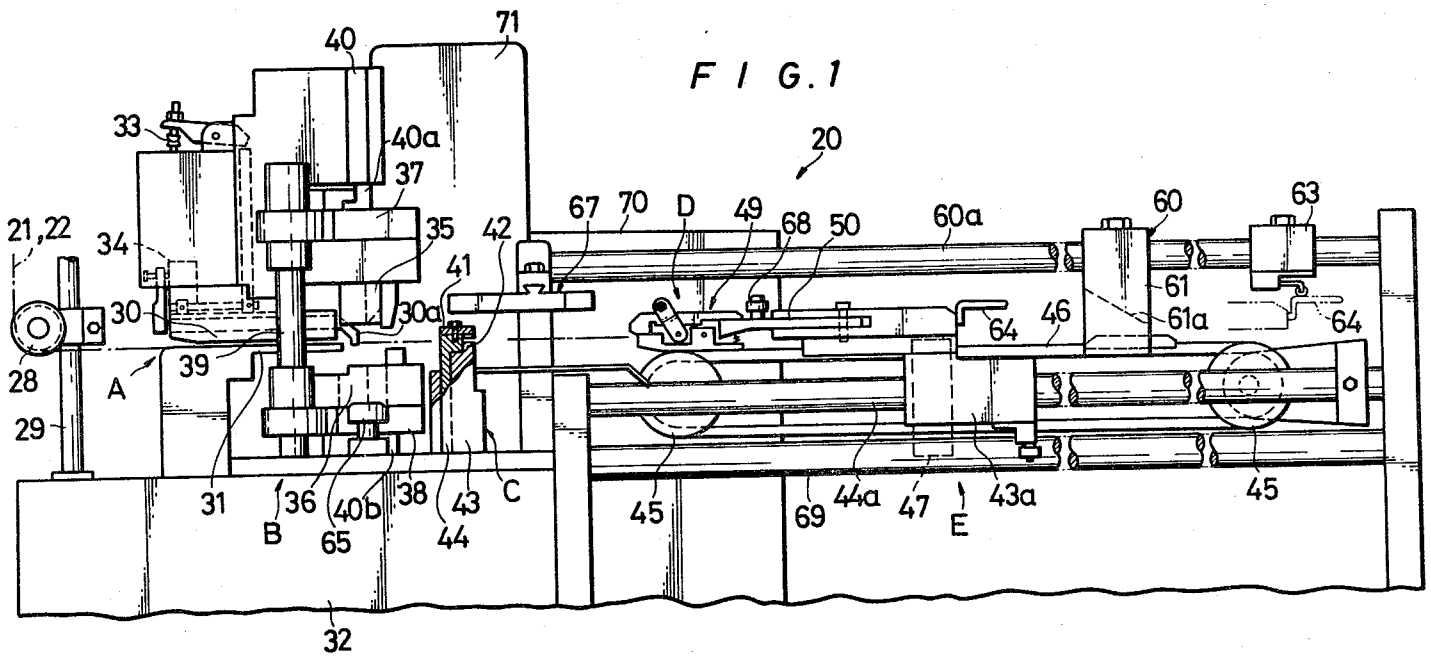
FIG. 1 is a front elevational view of an apparatus according to the present invention.
Figure 2:
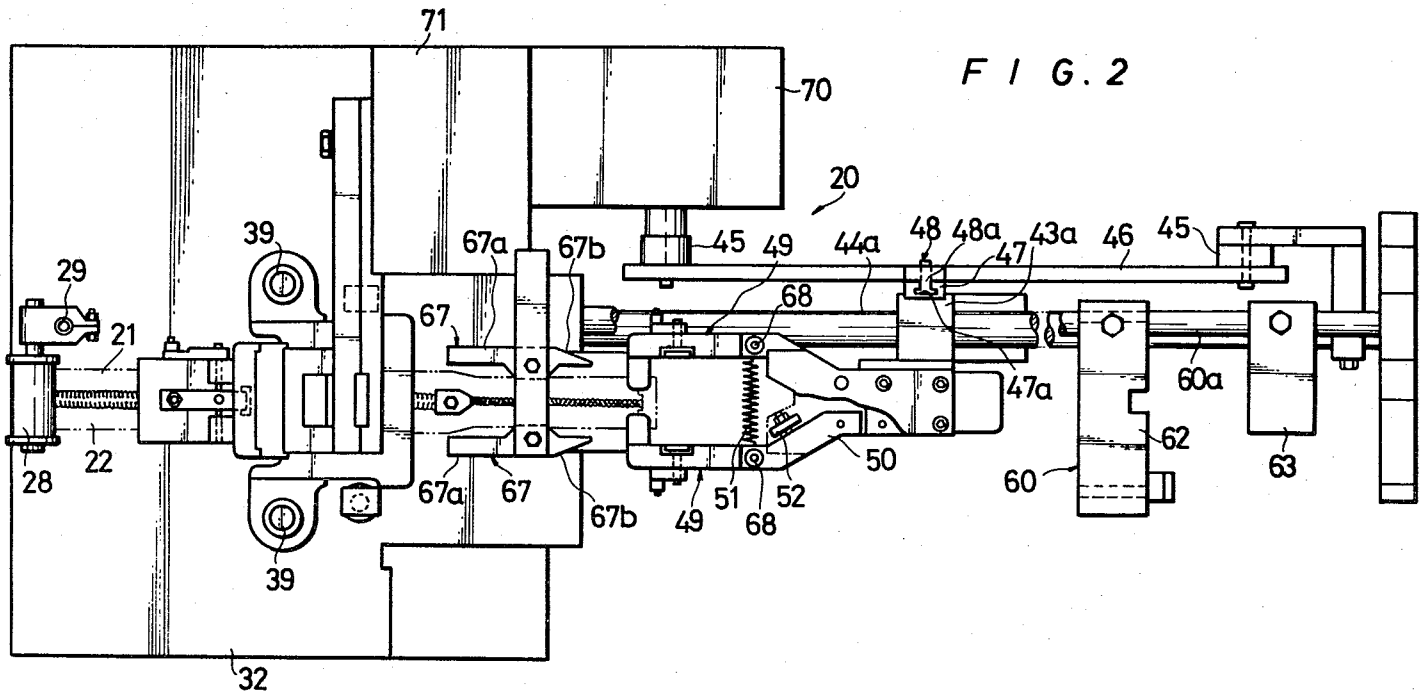
FIG. 2 is a plan view, with parts broken away, of the apparatus.

The principles of the present invention are particularly useful when embodied in an apparatus such as shown in FIGS. 1 and 2, generally indicated by the numeral 20.

The apparatus 20 generally comprises a fastener stringer guide unit A, a cutter unit B, a pairing unit C, a gripper unit D and a gripper unit moving and guiding unit E.

Figure 15:
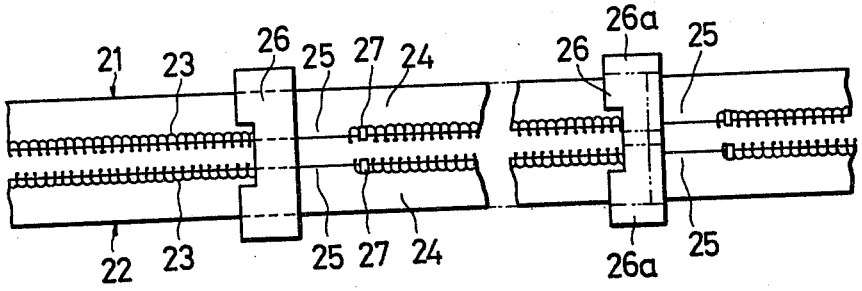
FIG. 15 is a fragmentary plan view of a pair of continuous slide fastener stringers to be severed and interengaged by the apparatus.
Figure 16:
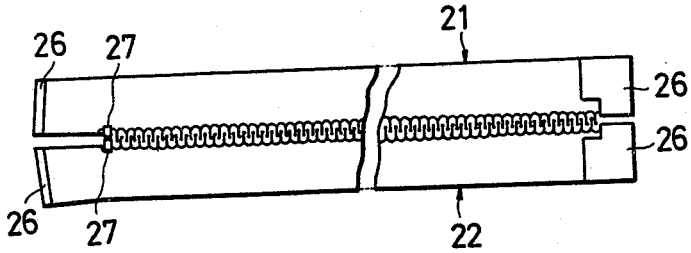
FIG. 16 is a plan view of a pair of slide fastener stringers of a slide fastener length which has been manufactured by the apparatus.

As shown in FIG. 15, a pair of continuous slide fastener stringers 21,22 each include a row of coupling elements 23 mounted on and along a longitudinal edge of a stringer tape 24. Each slide fastener stringer 21,22 also has a plurality of longitudinally spaced element-free gaps 25, a plurality of reinforcing films 26 of synthetic resin applied to the stringer tape 24 at the element-free gaps 25, and a plurality of top end stops 27 attached to the tape 24 adjacent to the element-free gaps 25. The slide fastener stringers 21,22 are supplied from a bobbin (not shown) to the guide unit A (FIG. 1) via a roller 28 rotatably mounted on a post 29 (FIGS. 1 and 2). The stringers 21,22, which had been interengaged initially, have been separated from each other by a separator or splitter (not shown) before being introduced into the apparatus 20.

The guide unit A, as shown in FIG. 1, comprises a pair of upper and lower guide plates 30,31. The lower guide plate 31 is fixed to a base 32 of the apparatus 20. The upper guide plate 30 is movable toward and away from the lower guide plate 31 for guiding therebetween the stringers 21,22. A slide fastener stringer stopping means **30*a*, mounted on the upper guide plate 30, is moved upwardly and downwardly by means of a solenoid 33. The solenoid 33 is energized when a switch 34 is actuated by an element-free gap detecting means (not shown). As the slide fastener stringers 21,22 are being advanced, the stopping means 30*a* is raised so as not to impede the feed of the stringers 21,22**.

Upon actuation of the switch 34 by the nonillustrated detecting means, the stopping means **30*a* is lowered to block the stringers 21,22, whereupon the stringers 21,22 are cut off transversely by the cutter unit B as described below. The stopping means 30*a* is slidable in the longitudinal direction of the stringers 21,22**, so that the latter can be stopped at an adjustable position.

Figure 3:
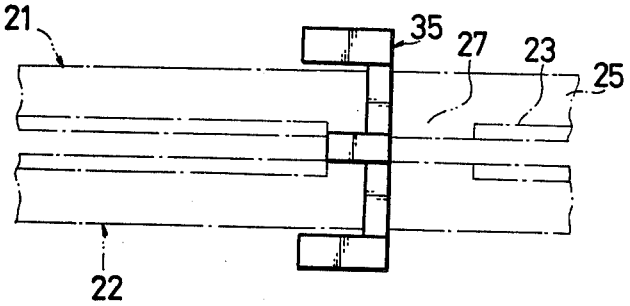
FIG. 3 is a bottom view of a punch, with a fragment of a pair of slide fastener stringers shown in phantom.
Figure 4:
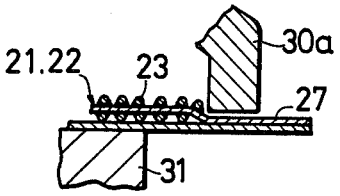
FIG. 4 is a cross-sectional view showing the manner in which a leading end portion of the slide fastener stringer is detected.

The cutter unit B is located just downstream of the guide unit A. The cutter unit B comprises a relatively movable punch 35 and die 36 respectively supported by a pair of support plates 37,38 which are vertically movably mounted on a pair of common guide posts 39,39 on the base 32. The support plate 37 for the punch 35 is operatively connected to an actuating lever 40 through the medium of a hook **40*a*, and the support plate 38 for the die 36 is connected to a ram 40***b* for vertical movement. The punch 35 has an E-shaped face, as shown in FIG. 3, so that the stringers 21,22 can be cut off along dash-and-dot lines (FIG. 15), thereby removing a pair of opposite marginal portions 26*a*,26*a* of the reinforcing film 26 which extend beyond respective outer edges of the stringers 21,21.

Designated at 71 in FIG. 2 is a drive means for the punch 35 and die 36. The drive means 71 may include a suitable clutch (not shown).

Figure 11:
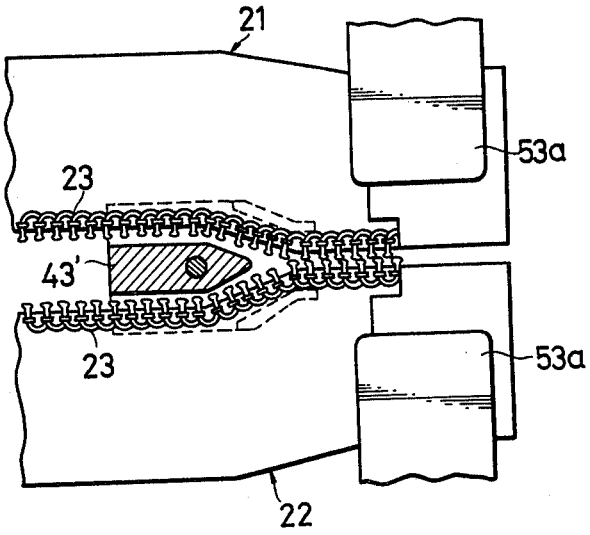
FIG. 11 is an enlarged view showing a portion of FIG. 10, with parts broken away.
Figure 12:
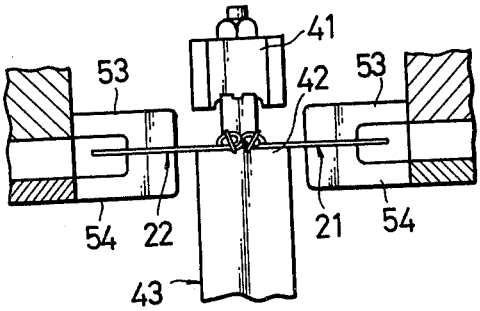
FIG. 12 is a side elevational view showing parts in their positions as leading end portions of the slide fastener stringers have just been introduced into the pairing unit.

The pairing unit C is located away from and downstream of the cutter unit B for pairing or mating the severed slide fastener stringers 21,22. The pairing unit C generally has a structure similar to that of an ordinary slider. The pairing unit C comprises a pair of upper and lower members 41,42. The lower member 42 includes a top end portion of a support block 43 (FIGS. 1 and 12–14) mounted on the base 32. A plunger 44 is vertically movably mounted on the cutter-unit side of the support block 43 and has a separator portion 43' (FIG. 11) one end of which is tapered. The upper member 41 is mounted on the separator portion 43' of the plunger 44. As the plunger 44 is lowered by means of a suitable device (not shown), the upper member 41 is moved from the position of FIG. 13 to that of FIG. 14, i.e. toward the lower member 42, to define between these two members 41,42 a Y-shaped guide channel for the slide fastener stringers 21,22 to be paired. Accordingly, the slide fastener stringers 21,22 are progressively interengaged, in the well known manner, as they pass the pairing unit C.

The gripper moving and guiding unit E is located downstream of the pairing unit C and constructed as follows. The gripper unit D is supported by a slide 43*a* (FIGS. 1 and 2) slidably mounted on a first guide rail 44*a* fixed at opposite ends to the base 32 of the apparatus 20. The first guide rail 44*a* extends horizontally. A slide moving means is disposed alongside the first guide rail 44*a*. The slide moving means includes a pair of horizontally spaced pulleys 45,45 and an endless belt 46 wound therearound, one of the pulleys 45 being reciprocably driven by a drive means 70 (FIG. 2) for rotation. The slide 43*a* is secured to the belt 46 by a pair of first and second conductor members 47,48 (FIG. 2). The first connector member 47 is fixed to the slide 43*a* and has a vertically extending T-shaped (as viewed in cross section) groove 47*a*. The second connector member 48 is secured to the belt 46 and has a vertically elongated projection 48*a* which is complementary to and is received in that T-shaped groove 47*a*. Thus, the gripper unit D is reciprocably movable along the first guide rail 44 in response to rotation of the pulleys 45 in clockwise and then counterclockwise directions.

Figure 5:
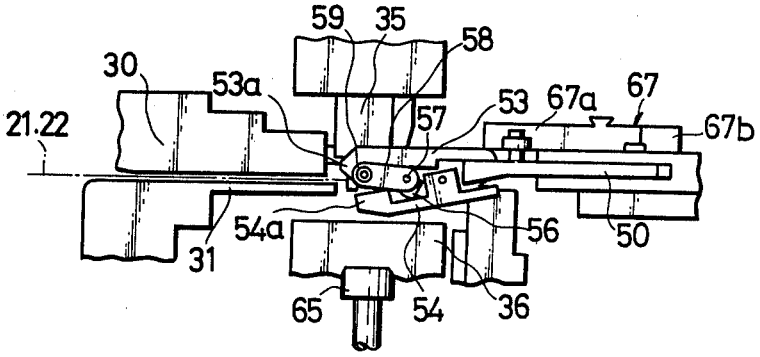
FIG. 5 is a front elevational view showing parts in their positions as the severed slide fastener stringers are about to be gripped.
Figure 6:
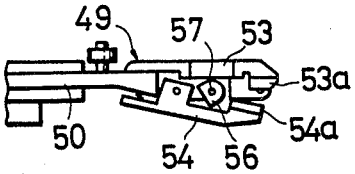
FIG. 6 is a rear elevational view of a gripper shown in FIG. 5.
Figure 7:
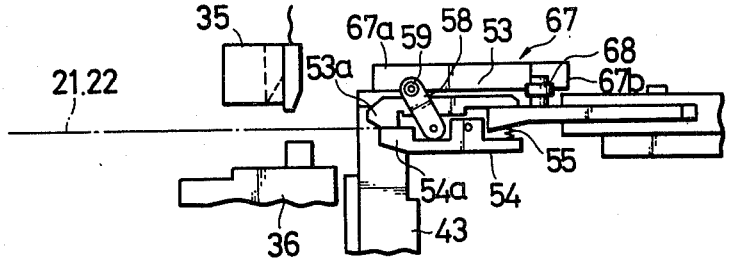
FIG. 7 is a front elevational view showing parts in their positions as the slide fastener stringers are being interengaged.

The gripper unit D comprises a pair of horizontally spaced grippers 49,49 respectively supported by a pair of levers 50,50 each pivotably mounted on the slide 43*a*. An extension spring 51 (FIG. 2) is mounted between the two levers 50,50 to normally urge them toward each other. The amount of such relative angular movement of the levers 50,50 is restricted by a pair of stops 52,52 (only one of which is shown here) each adjustably mounted on one of the levers 50,50. Each of the grippers 49,49 includes a pair of relatively pivotable upper and lower grip members 53,54 (FIGS. 1, 5 and 6). Each upper grip member 53 is mounted on one of the levers 50,50. The lower grip member 54 is pivotably mounted on the corresponding upper grip member 53. A compression spring 55 (FIG. 7) is mounted between the lever 50 and the lower grip member 54 so as to normally urge the latter to pivot clockwise; that is, a tip end portion 54*a* (FIGS. 5, 6 and 7) of the lower grip member 54 is normally urged against a corresponding portion 53*a* of the upper grip member 53. The tip end portion 53*a*,54*a* of each of the upper and lower grip member 53,54 is inwardly directed. As shown in FIGS. 5 and 6, a cam disk 56 is rotatably mounted on the upper grip member 53 by a pin 57. A link 58 is attached to the cam disk 56 and is pivotable between its first position (FIG. 7) and its second position (FIG. 5). The shape and size of the cam disk 56 is such that, when the link 58 is in its first position, the tip end portions 53*a*,54*a* of the upper and lower grip members 53,54 abut against each other and such that, when the link 58 is in its second position, they are spaced apart from each other. Attached to a free end of the link 58 is a roller 59 (FIG. 1, 5 and 7).

A gateway 60 (FIGS. 1 and 2) is mounted on a second rail 60*a* parallel to the first guide rail 44*a*. The gateway 60 includes a pair of parallel side (or vertical) plates 61,61 and a top (or horizontal) plate 62 extending therebetween. Each of the side plates 61 has a cam surface 61*a* slanting down to the right (as viewed in FIG. 1). As the gripper 49 passes through the gateway 60 rightwardly (as viewed in FIG. 1), the roller 59 on the link 58 rolls on and along the cam surface 61*a*, causing the link 58 to fall flat (FIG. 5). As a result, the gripper 49 is opened. A limit switch 63 is mounted on the second rail 60*a* at a preselected position downstream of the gateway 60 and is operable, when the gripper unit D arrives at that preselected position indicated in phantom lines in FIG. 1, to open a tray (not shown) disposed below the guide rail 44*a* for discharging the coupled slide fastener stringers 21,22 and at the same time, operable to produce an electrical signal which is supplied to the drive means 70 (FIG. 2) for causing the pulleys 45 to rotate in a counterclockwise direction. The gripper unit D is thus moved leftwardly (as viewed in FIG. 1). The gripper unit D includes a feeler plate 64 for actuating the limit switch 63.

At the severing station where the continuous slide fastener stringers 21,22 are severed, a lifter 65 (FIGS. 1 and 5) is located for causing the link 58 to pivot clockwise (as viewed in FIG. 5), the lifter 65 being vertically movably mounted on the base 32. The gripper 49 is thus closed to grip the individual slide fastener stringer 21,22.

Figure 8:
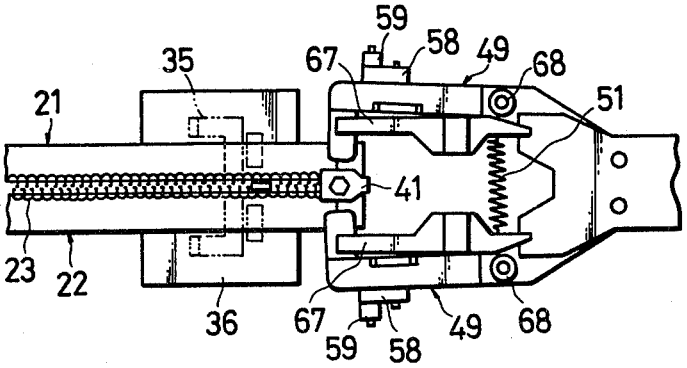
FIG. 8 is a plan view corresponding to FIG. 7.

At that time, the two grippers 49,49 are spaced away from each other in order to grip the spaced slide fastener stringers 21,22. Then, the grippers 49,49 pivot so as to approach each other at their free end to bring the opposed stringers 21,22 close to each other for introduction into the pairing unit C, as shown in FIG. 8. For this purpose, a pair of transversely spaced cam plates 67,67 (FIGS. 1 and 2) is positioned in the path of travel of the gripper unit D. Each cam plate 67 has an outwardly facing cam surface which is engageably with a roller 68 (FIGS. 1, 2, 7 and 8) mounted on the corresponding one of the pivotable levers 50,50. The cam surface of each cam plate 67 is composed of a first section 67*a* extending parallel to the path of the gripper unit D and a second section 67*b* extending inwardly obliquely.

An auxiliary guide rail 69 (FIG. 1) is disposed below the first guide rail 44*a* and extends parallel thereto. The auxiliary guide rail 69 serves to prevent the slide 43*a* from being angularly displaced about the guide rail 44*a*.

The operation of the apparatus 20 is described as follows:

A pair of the unengaged slide fastener stringers 21,22 is advanced, through the guide unit A, by being pulled by the preceding pair of stringers to which they are attached, to such a point that the reinforcing film 26 at the leading end of the stringers 21,22 is located between the punch 35 and the die 36, whereupon the punch 35 and the die 36 are moved toward each other to cut the stringers 21,22 across the element-free gaps 25. At that time, the marginal portions 26*a*,26*a* of the reinforcing film 26 which extend beyond the inner and outer edges of the stringers 21,22 are removed.

Figure 9:
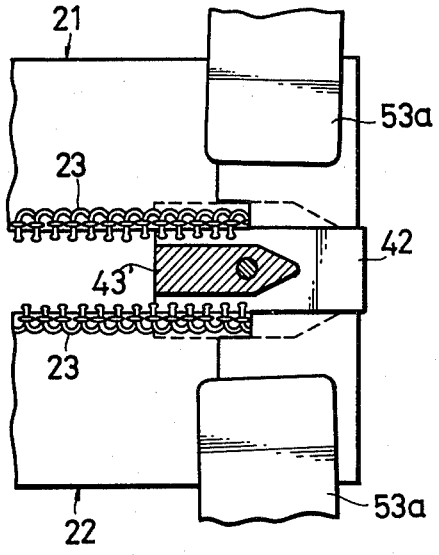
FIG. 9 is an enlarged view showing a portion of FIG. 8, with parts broken away.
Figure 10:
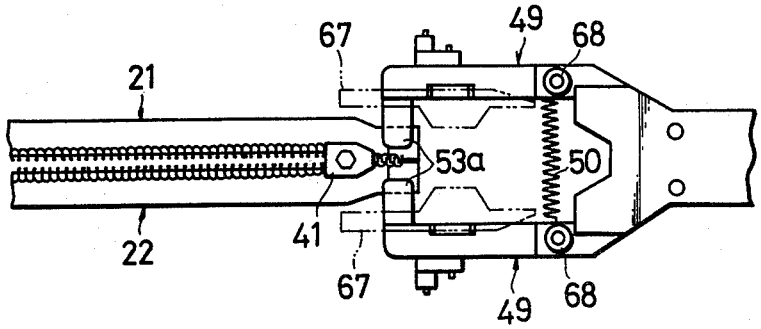
FIG. 10 is a view similar to FIG. 8, but showing parts in their positions as the leading end portions have been moved past a pairing unit.
Figure 13:
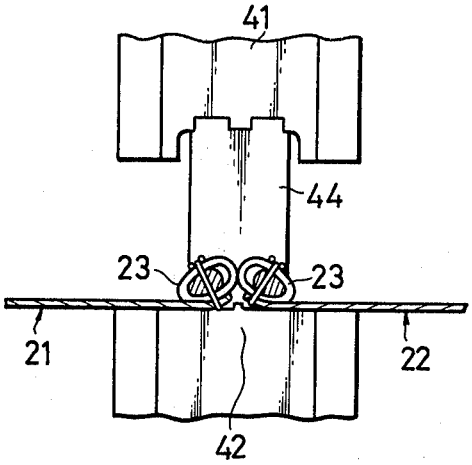
FIG. 13 is an enlarged view showing a portion of FIG. 12.
Figure 14:
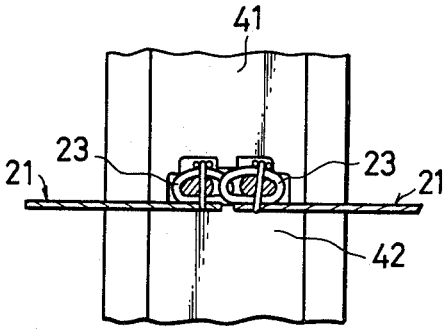
FIG. 14 is a view similar to FIG. 13 showing an upper member of the pairing unit in lowered position.

After the preceding pair of stringers has been processed and released, the grippers 49,49 are returned to their retracted position where they grip leading end portions of the severed slide fastener stringers 21,22. The grippers 49,49 are then moved downstream to bring the leading end portions of the stringers 21,22 to the pairing unit C such that the unengaged fastener element rows 23,23 are introduced into the pairing unit C. (This movement also advances a subsequent pair of stringers that are still attached.) The upper member 41 of the pairing unit C is initially in raised position (FIGS. 12 and 13), and the grippers 49,49 commence approaching each other by means of the cam plates 67,67 about the time when the tip end portions 54*a*,54*a* of the grippers 49,49 are moved past the midportion of the separator 43' of the pairing unit C (FIG. 9). When the stringers 21,22 are advanced further such that the opposed fastener element rows 23,23 are in engagement with each other as shown in FIG. 13, the upper member 41 of the pairing unit C is lowered to press the fastener element rows 23,23. The opposed fastener element rows 23,23 are thereby interengaged completely.

The grippers 49,49 with the stringers 21,22 gripped thereby are moved further downstream until the next element-free gap 25 is located between the punch 35 and the die 36, whereupon the stringers 21,22 are cut across the next element-free gap 25 as described above, during which cutting time the moving of the grippers 49,49 is temporarily stopped, thus severing the trailing edge of the pair of stringers from the following pair.

After that, the grippers 49,49 are again moved downstream until the feeler plate 64 of the gripper unit D hits the unnumbered actuator of the limit switch 63. The switch 63 is thereby actuated to produce a signal for causing the grippers 49,49 to release the stringers and to return to the original retracted position for gripping the next pair of stringers.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for severing a pair of unengaged slide fastener stringers of a continuous length and for pairing the severed slide fastener stringers, such continuous slide fastener stringers including a plurality of reinforcing strips each attached to one of longitudinally spaced, transversely aligned pairs of element-free portions, said apparatus comprising:

(a) means for severing the continuous slide fastener stringers transversely across the one of such plurality of pairs of element-free portions;

(b) means for pairing the severed slide fastener stringers, said pairing means including a fixed first member and a second member movable toward said first member to define between said first and second members a y-shaped passage for the slide fastener stringers, and to press the stringers therebetween; and (c) a pair of grippers for gripping the slide fastener stringers, said grippers being jointly reciprocable between a first position adjacent to said severing means and a second position disposed away from said first position for advancing the slide fastener stringers along a longitudinal path through both said means, said pair of grippers being pivotable toward each other for introducing the free ends of the separated slide fastener stringers into said pairing means.

2. An apparatus according to claim 1, said severing means including a relatively movable die and punch adapted to remove surplus portions of the reinforcing strips.

3. An apparatus according to claim 1, comprising means for supporting said grippers, said supporting means including a single straight rail extending parallel to said longitudinal path, and a slide slidably mounted on said rail for only linear movement therealong, said grippers being mounted on said slide.

4. An apparatus according to claim 3, further comprising drive means reciprocably driving said slide along said rail.

5. An apparatus according to claim 4, said drive means including a reciprocably drivable endless belt extending along said longitudinal path, said slide being secured to said endless belt.

6. An apparatus according to claim 1, including means operative on said grippers for closing said grippers at said first position, and means operative on said grippers for opening said grippers at said second position.

7. An apparatus according to claim 1, including a pair of transversely spaced fixed cam plates for regulating the pivotal movement of said pair of grippers toward and away from each other in response to movement of said pair of grippers in the direction of said longitudinal path.

* * * * *